United States Patent [19]

Matherne

[11] 4,223,892

[45] Sep. 23, 1980

[54] STATEGY GAME

[76] Inventor: Steven J. Matherne, 12038 Charlwood St., Artesia, Calif. 90701

[21] Appl. No.: 856,662

[22] Filed: Dec. 2, 1977

[51] Int. Cl.[3] ..... A63F 3/00

[52] U.S. Cl. ..... 273/248

[58] Field of Search ..... 273/243, 248, 249, 250, 273/251, 246

[56] References Cited

U.S. PATENT DOCUMENTS

| | | | |
|---|---|---|---|
| 1,353,764 | 9/1920 | Lambert | 273/248 |
| 2,611,616 | 9/1952 | Kloss | 273/249 |
| 3,414,264 | 12/1968 | Schriber | 273/249 |
| 3,643,957 | 2/1972 | Bryant | 273/249 |
| 3,722,885 | 3/1973 | Leaf | 272/93 X |
| 4,004,809 | 1/1977 | Schreiber | 273/248 |
| 4,004,810 | 1/1977 | Hernie | 273/249 |
| 4,116,450 | 9/1978 | Darrell | 273/249 |
| 4,124,212 | 11/1978 | Normart | 273/248 |
| 4,147,359 | 4/1979 | King | 273/248 X |

*Primary Examiner*—Richard C. Pinkham

*Assistant Examiner*—Scott L. Brown

*Attorney, Agent, or Firm*—Jack C. Munro

[57] ABSTRACT

A game divided into a plurality of separate substantially similar playing sections one for each player. Each playing section is divided into a plurality of sequentially arranged playing member resting areas. Each playing section is differently color coded and has a correspondingly coded playing member. The player of a particular playing section throws a die which includes written indicia directing the player to select a card from either a first stack of cards or a second stack of cards. The first stack of cards includes a series of numerical cards and also a series of coded cards with the coded cards to correspond by color to the color arrangement within each playing section. The second stack of cards includes a multitude of different instructions directing movement of a pariticular playing member within its particular playing section toward its finish line. A safety area is in each section, and each section has areas corresponding in color to different sections.

9 Claims, 17 Drawing Figures

STATEGY GAME

BACKGROUND OF THE INVENTION

The field of this invention relates to games and more particularly a game which is played upon a board which is adapted to be placed upon a table or other similar planar surface.

The playing of games that include a game board is most common. There is a substantial multitude of board games and because there are so many different board games, there is a substantial variety in the type of play of such games. Whether one particular board game is better to play than another board game takes into consideration several factors such as the interest of the players, whether the game includes the element of skill, or whether the game includes the element of chance, the interrelationship between chance and skill, complexity, simplicity, and so forth.

SUMMARY OF THE INVENTION

The game of this invention is believed to be summarily described in the Abstract of the Disclosure and reference is to be had thereto.

The primary object of the game of this invention is to construct a game which is interesting and challenging to play by a plurality of players and which also can be constructed inexpensively thereby minimizing manufacturing costs.

BRIEF DESCRIPTION OF THE DRAWINGS

FIG. 5(*b*) is an example of a coded card which is also employed within the first stack of cards within the game of this invention.

DETAILED DESCRIPTION OF THE SHOWN EMBODIMENT

Figure 1:
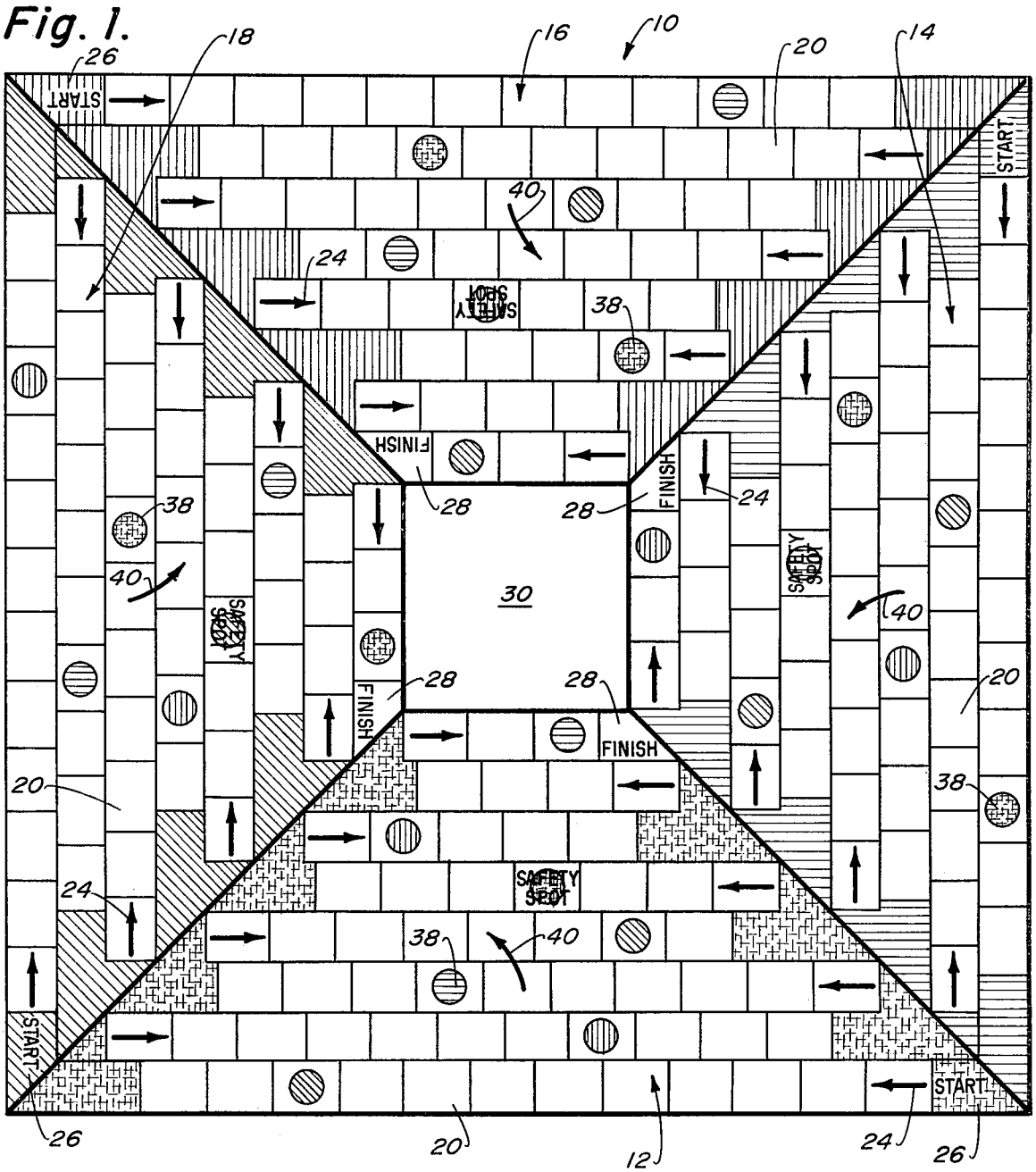
FIG. 1 is a plan view of the game board of the game of this invention.

Referring particularly to the drawings there is shown in FIG. 1 the game board 10 of this invention which will normally be constructed to a thin sheet material such as paper, wood, or plastic. The game board 10 is shown constructed of a preferable square configuration. However, any desireable type of configuration could be employed.

The game board 10 is divided into sections 12, 14, 16 and 18. Each of the playing sections 12, 14, 16 and 18 are laid out in precisely the same manner. The only difference between the playing sections is that each is color coded differently as for example, playing section 12 being color coded yellow, playing section 14 being color coded blue, playing section 16 being color coded red and playing section 18 being color coded green.

However, the color codings may be readily altered if it is desired.

Figure 4:
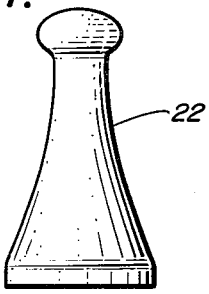
FIG. 4 is an elevational view of an illustrative type of playing member which is to be incorporated within the game of this invention.

Each playing section includes a sequential arrangement of playing member resting areas 20. The playing member resting areas are divided into a plurality of rows with the rows being located on top of the other and each row including a plurality of playing member resting areas. The row adjacent the periphery of the game board 10 has twelve in number of the resting areas 20 with each succeeding inwardly located row including fewer in number of resting areas until the inwardmost row of each playing section has only four in number of resting areas 20. A playing member 22, such as is shown in FIG. 4, is to cooperate with each playing section and is adapted during the course of play of the game to be moved in the direction represented by arrows 24 back and forth across each playing section and across each row of the resting areas 20. The objective of the game, as will be explained further on in this specification, is to begin at the resting area 26, denoted "start", and have the playing member terminate at the resting area 28 denoted "finish". Each playing member 22 is to be color coded in a manner to correspond to its particular playing section. There is an area 30 located in the center most playing board 10 which is adapted to facilitate location of two stacks of cards which will be explained further on in this specification. A first stack of cards is to include cards generally of the type shown in FIGS. 5(*a*) and 5(*b*). The type of card shown in FIG. 5(*a*) is a numerical type card and each card is to include a number such as shown in the numeral "2" in FIG. 5(*a*). Each card is to be numbered a different number from one through ten. There are to be five sets of such cards with each set including a single card of each number one through ten. This means there will be fifty in number of cards such as cards 5(*a*).

Figure 5A:
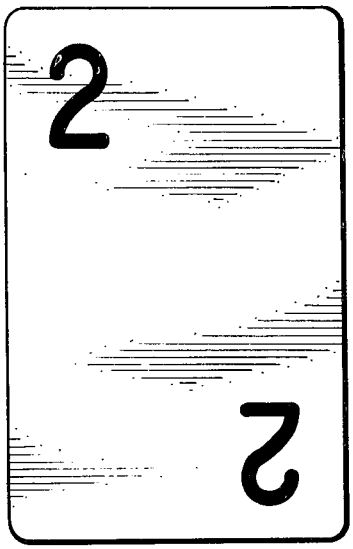
FIG. 5(*a*) is an example of a numerical playing card which is employed within the first stack of cards of the game of this invention.
Figure 5B:
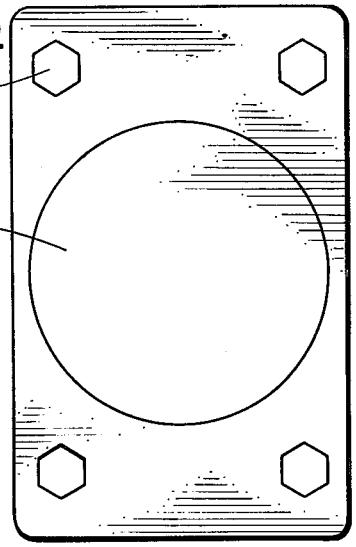
Figure 6A:
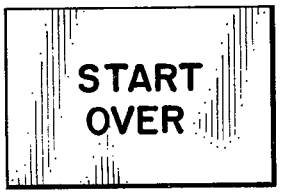
FIGS. 6(*a*) through 6(*k*) show different instructional cards which is employed in the second stack of cards of the game of this invention.
Figure 6B:
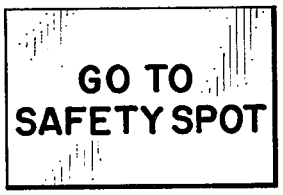
Figure 6C:
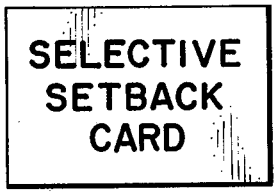
Figure 6D:
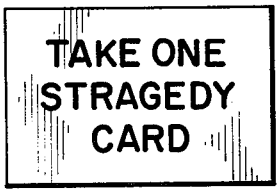
Figure 6E:
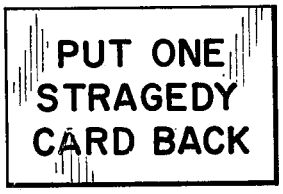
Figure 6F:
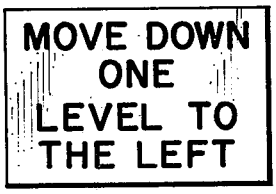
Figure 6G:
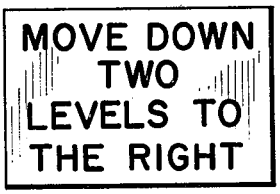
Figure 6H:
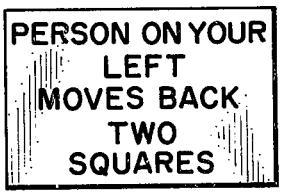
Figure 6I:
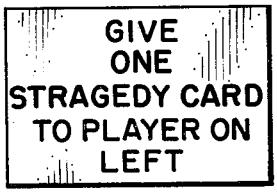
Figure 6J:
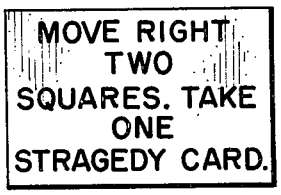
Figure 6K:
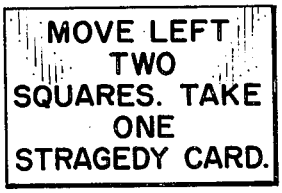

Also interspersed through the numerical type of cards there is to be the coded cards such as shown in FIG. 5(*b*). There is to be four different sets with each set of cards including six in number of cards. Each of the cards in FIG. 5(*b*) include color coded hexigonal shaped areas 32 in each corner thereof. Each set of the cards 32 are to be color coded to correspond to a particular color of each playing section. In other words, there will be one set of yellow cards, one set of blue cards, one set of green cards, and one set of red cards.

Each card within FIG. 5(*b*) includes a central enlarged section 34. This section 34 is to include a color coding. The color of the enlarged section 34 never coincides with the color of sections 32. Since there are four different colors employed, for a given color of section 32, the other remaining three colors are employed twice to make up the six cards for each grouping of cards. In other words, a card with area 32 being red, there will be two in number of cards with area 34 blue and two in number of cards with area 34 yellow and two in number of cards with area 34 green. The total number of cards such as cards in FIG. 5(*b*) will be 24 in number. Therefore, the total number of cards within the first stack of cards will be 74 in number of different cards.

The second stack of cards is to include the series of difference instructions and are depicted illustratively within FIGS. 6(*a*) to 6(*k*). Examples of different types of instructions are as is shown in FIGS. 6(*a*) to 6(*k*): "start over", "go to safety spot", "selective set back card", "take one stragedy card", put one stragedy card back", "move down 1 level to the left", "move down 2 levels to the right", "person on your left move back 2 squares", "give one stragedy card to player on left", "move right two squares", "take one more stragedy card", "move left two squares", "take one stragedy card". There are four in number of each card with the same dictation on the card with the exception that the "start over" card numbers only two. The total number of the different types of cards, excepting the "start over" card, is ten in number. Therefore, there will be a total number of 42 different cards within the second stack of cards.

Figure 2:
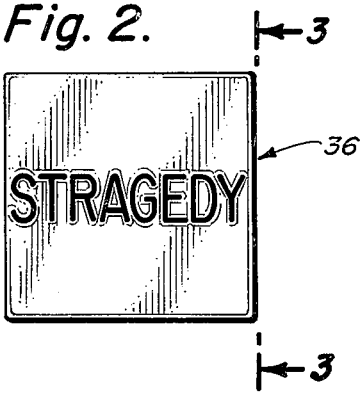
FIG. 2 is a view of one end of a die which is employed within the game of this invention with the die being used as a random selection means.
Figure 3:
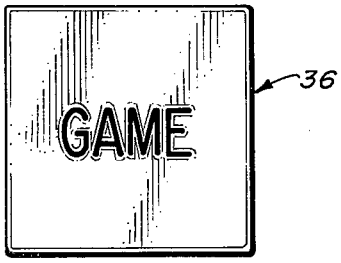
FIG. 3 is a side view of the die of FIG. 2 taken along line 3—3 of FIG. 2.

Referring particularly to FIGS. 2 and 3 a random selection means in the form of a die 36 is shown. The die 36 will be conventionally constructed in a cube having six sides with three of the sides to include the word "stragedy" and three remaining sides to include the word "game". The first stack of cards represented by the type of cards shown in FIGS. 5(*a*) and 5(*b*), are to be denoted "stragedy" cards. The second stack of cards, shown to be the type of cards within FIG. 6(*a*) to 6(*k*) is to be denoted "game" cards. By the player throwing the die, that player is instructed whether to select a "stragedy" card or a "game" card. Both stacks of cards are located with the face of the card down. When a particular card has been drawn and played, that card is then placed in a discard pile. Only one card at a time can be removed from each stack of cards, or placed on top of the stacked cards. On a particular player's turn, the number of the card shown within FIG. 5(*a*) is to be equivalent to the number of player resting areas 20 that a playing member 22 can be moved in sequence.

It is to be noted that within each playing section, 12, 14, 16 and 18 there are a plurality of different color coded areas 38. There are seven in number of areas 38 within each playing section. Noting in particular the playing section 12, there is only one in number of areas 38 that is color coded to correspond with playing section 12 (that is colored yellow). However, there are two in number of areas 38 color coded red, two others that are color coded green, and two others that are color coded blue. Each of the areas 38 is located within a particular resting area 20 with the areas 38 being spaced substantially from each other within each playing section. The area 38 that is color coded the same color as the playing section includes the verbage "safety spot". The "safety spot" is located substantially within the center of each playing section.

The playing of the game of this invention is accomplished as follows:

The first player throws the die 36 and draws either a "stragedy card" or a "game card". The "stragedy card" is drawn, the player must place it face down in front of himself and play moves to the next player. A "stragedy card" cannot be played on the same turn that it is drawn. The "game card" is played on the same turn as drawn and if on the first turn the "game card" directs the player to do something that is not possible, such as move down one level to the left, that move is ignored and the "game card" is placed at the bottom of the stack. If the move can be accomplished, the move is then so accomplished.

If, at a later turn the player is able to fulfill the request of moving down levels to the left or right, he does so by moving downward and right or left (as directed) into the appropriate resting area which overlaps in the direction depicted by the card. The color coded areas along the side of the playing section 12, 14, 16 and 18 are where the changes in levels of the playing member occurs and each individual colored area is to be taken as the equivalent of the player resting area 20.

As play continues, the stragedy cards can be accumulated, and may be played at any appropriate time constituting a turn. The "stragedy card" can be played by the particular player himself and if the color of area 32 of the card corresponds to the color of his playing member, the player can then move his playing member to the color area 30 which corresponds to the color area 34 of the card. However, this movement is limited in that he must go to the nearest corresponding colored area 38 within his playing section. Therefore in most instances, it would be desireable for the player himself to move his playing member in the forward direction towards the finish line. Therefore the player would normally only play the card at the appropriate time to accomplish this end.

However, the player can play a card directing movement of another player's playing member when the color code within area 32 corresponds to a particular playing member of an opponent. Normally the procedure would be to cause the opponent's playing member to move in the direction opposite the finish resting area 28.

Within the "stragedy cards", if a player has received a numerical stragedy card, he may play this card at a given turn therefore moving his playing member forward the numerically designated playing resting areas. There is an arrow 40 approximately centrally located within each playing section 12, 14, 16 and 18. The arrow 40 is to function as a short cut that if a playing member for that particular section lands on the tail of the arrow at the end of a turn, it may be moved upward to the head of the arrow in the next suceeding row of playing member resting areas. A playing member is only moved forward along with the direction of the arrow and never backward.

If a given player receives the "selective set back" card, the closest player to winning other than the receiver of that card must move back to it's own "start" resting area. But if the player closest to winning is on his "safety spot", he can not be attacked by another player and then the "selective set back card" is returned to the bottom of the stack of cards and not employed. The returning to the "start" section 26 is only if the playing member is located between the "start" section and the "safety spot". If the playing member is between the "safety spot" and the finish line, and the winning player is requested to move back due to the "selective set back" card, the winning player is then only moved back to the "safety spot".

The "safety spot" is also safe from the "start over" card. But the "safety spot" does not protect a player from the instructions of cards shown in FIGS. 6(*e*), (*f*), (*g*), (*i*), (*j*), or (*k*).

In order to end the game, a given playing member of a player must end precisely on its finish resting area 28. This is accomplished through proper playing of the stragedy cards. If for instance, a particular playing member has only three resting areas to move to reach the finish 28, and that player only has a numerical six, the player moves forward three positions, and then backward three positions in order to move the total of six positions and ending up precisely where the playing member was originally located. Besides having to end up at the finish 28 with the exact number of moves, the winning player must also have no stragedy cards in his possession when located at the finish resting area 28.

Therefore, what is claimed is:

1. A game comprising:

a game board being divided into a plurality of separate playing sections, each said section being substantially similar, each section to be used by an individual player, each said section including first indicia, each said first indicia to differentiate each said playing section from each other, each said playing section including a single path of a plurality of sequentially arranged playing member resting areas;

a separate playing member for each said playing section adapted to be moved sequentially across said playing member resting areas by the appropriate player for the playing section, each said playing member of each said playing section including second indicia to differentiate said playing members from each other, said second indicia of a said playing member to correspond to a said first indicia of a said playing section;

a first stack of cards being divided into numerical type cards and coded cards, there being a said coded card to correspond to each said first indicia;

a second stack of cards including a multitude of different instructions directing movement of a said playing member upon its respective said playing section; and random selection means to be operated by a player during the player's playing turn to direct the player to draw an individual card of either said first stack of cards or said second stack of cards;

a plurality of said playing member resting areas within each of said playing sections including first indicia which corresponds to the particular first indicia of another said playing section.

2. The game as defined in claim 1 wherein:

said first indicia comprising a plurality of colors with there being a separate color for each said playing section.

3. The game as defined in claim 2 wherein:

said second indicia comprising a plurality of colors with there being a separate color for each said playing member.

4. A game comprising:

a game board being divided into a plurality of separate playing sections, each said section being substantially similar, each section to be used by an individual player, each said section including first indicia, each said first indicia to differentiate each said playing section from each other, each said playing section including a single path or a plurality of sequentially arranged playing member resting areas;

a separate playing member for each said playing section adapted to be moved sequentially across said playing member resting areas by the appropriate player for the playing section, each said playing member of each said playing section including second indicia to differentiate said playing members from each other, said second indicia of a said playing member to correspond to a said first indicia of a said playing section;

a first stack of cards being divided into numerical type cards and coded cards, there being a said coded card to correspond to each said first indicia;

a second stack of cards including a multitude of different instructions directing movement of a said playing member upon its respective said playing section; and random selection means to be operated by a player during the player's playing turn to direct the player to draw an individual card of either said first stack of cards or said second stack of cards;

said random selection means comprising a manually throwable die;

said first indicia comprising a plurality of colors with there being a separate color for each said playing section;

said second indicia comprising a plurality of colors with there being a separate color for each said playing member;

a plurality of said playing member resting areas within each of said playing sections including first indicia of another said playing section.

5. A game comprising:

a game board being divided into a plurality of separate playing sections, each said section being substantially similar, each section to be used by an individual player, each said section including first indicia, each said first indicia to differentiate each said playing section from each other, each said playing section including a single path of a plurality of sequentially arranged playing member resting areas;

a separate playing member for each said playing section adapted to be moved sequentially across said playing member resting areas by the appropriate player for the playing section, each said playing member of each said playing section including second indicia to differentiate said playing members from each other, said second indicia of a said playing member to correspond to a said first indicia of a said playing section;

a first stack of cards being divided into numerical type cards and coded cards, there being a said coded card to correspond to each said first indicia;

a second stack of cards including a multitude of different instructions directing movement of a said playing member upon its respective said playing section; and random selection means to be operated by a player during the player's playing turn to direct the player to draw an individual card of either said first stack of cards or said second stack of cards; and at least one said playing member resting area within each of said playing sections including first indicia which corresponds to the particular first indicia of another said playing section.

6. The game as defined in claim 5 wherein:

said random selection means comprising a manually throwable die.

7. The game as defined in claim 6 wherein:

said first indicia comprising a plurality of colors with there being a separate color for each said playing section.

8. The game as defined in claim 7 wherein:

said second indicia comprising a plurality of colors with there being a separate color for each said playing member.

9. A game comprising:

a game board being divided into a plurality of separate playing sections, each said playing section being substantially similar, each said playing section to be used by an individual player, each said playing section including first indicia, each said first indicia to differentiate each said playing section from each other, each said playing section including a single path of a plurality of sequentially arranged playing member resting areas;

a separate playing member for each said playing section adapted to be moved sequentially across said playing member resting areas by the appropriate player for the playing section, each said playing member of each said playing section including second indicia to differentiate said playing member from each other, said second indicia of a said playing member to correspond to a said first indicia of a said playing section;

a first stack of cards being divided into numerical type cards and coded cards, there being a said coded card to correspond to each said first indicia;

a second stack of cards including a multitude of different instructions directing movement of a said playing member upon its respective said playing section;

random selection means to be operated by a player during the player's playing turn to direct the player to draw an individual card of either said first stack or cards of said second stack of cards;

one of said playing member resting areas within each of said playing sections including first indicia which corresponds to the particular first indicia of that respective said playing section, whereby the said one playing member resting area functions as a safety spot for a said playing member which occupies the said one playing member resting area, said safety spot protects the said playing member against certain instructions of said second stack of cards; and a plurality of said playing member resting areas within each of said playing sections including first indicia which corresponds to the particular first indicia of another said playing section.

* * * * *